US007479891B2

(12) United States Patent
Boujon

(10) Patent No.: US 7,479,891 B2
(45) Date of Patent: Jan. 20, 2009

(54) DEVICE FOR RESCUE AND SAFETY FOR SWIMMING POOLS AND LEISURE PARKS

(76) Inventor: Claire-Lise Boujon, 33 rue de Montbrilliant, CH 1202 Geneve (CH)

( * ) Notice: Subject to any disclaimer, the term of this patent is extended or adjusted under 35 U.S.C. 154(b) by 0 days.

(21) Appl. No.: 10/524,306

(22) Filed: Mar. 22, 2006

(65) Prior Publication Data

US 2006/0214805 A1 Sep. 28, 2006

(51) Int. Cl.
*G08B 23/00* (2006.01)

(52) U.S. Cl. ..... 340/573.6; 340/540; 340/539.1; 340/539.3; 340/539.26; 340/573.1; 340/574; 340/686.1; 340/984; 340/989; 340/990; 342/126; 342/450; 342/457

(58) Field of Classification Search ..... 340/573.6, 340/540, 539.1, 539.3, 539.26, 573.1, 574, 340/686.1, 984, 989, 990; 342/126, 450, 342/457

See application file for complete search history.

(56) References Cited

U.S. PATENT DOCUMENTS

| | | | | |
|---|---|---|---|---|
| 4,063,410 | A | 12/1977 | Welling | |
| 4,129,905 | A | 12/1978 | Niemirow | |
| 5,267,358 | A | 12/1993 | Roy et al. | |
| 5,385,518 | A | 1/1995 | Turner | |
| 5,408,222 | A | 4/1995 | Yaffe et al. | |
| 5,421,757 | A | 6/1995 | Basiliere | |
| 5,486,814 | A | 1/1996 | Quinones | |
| 5,515,858 | A | 5/1996 | Myllymaki | |
| 5,652,570 | A | 7/1997 | Lepkofker | |
| 6,127,930 | A | 10/2000 | Steffanus | |
| 6,198,390 | B1 * | 3/2001 | Schlager et al. | 340/540 |
| 6,574,804 | B1 | 6/2003 | Boujon | |
| 7,063,582 | B2 | 6/2006 | Boujon | |

FOREIGN PATENT DOCUMENTS

| | | |
|---|---|---|
| DE | 32 10 590 | 10/1983 |
| EP | 0 261 917 | 3/1988 |
| EP | 0846440 | 6/1998 |
| FR | 2505914 | 11/1982 |
| FR | 2 678669 | 1/1993 |
| GB | 1 101 585 | 1/1968 |
| GB | 2 229 645 | 10/1990 |
| GB | 2 254 215 | 9/1992 |
| WO | WO 95 34056 | 12/1995 |
| WO | WO 97 18542 | 5/1997 |
| WO | WO 01/06076 | 1/2001 |

* cited by examiner

*Primary Examiner*—Daryl C Pope

(57) ABSTRACT

A rescue and safety device for swimming-pools and amusement parks, consisting of a wristband containing a cardiac-arrest detector, a panic button, a location device and, optionally, a water detector, triggered by immersion syncope, cardiac arrest or an accident; a rescue device, especially if an inflatable grid has been installed on the bottom of the pool, that can uplift any person in difficulties from the bottom of the pool.

22 Claims, 8 Drawing Sheets

DEVICE FOR RESCUE AND SAFETY FOR SWIMMING POOLS AND LEISURE PARKS

CROSS REFERENCE TO RELATED APPLICATIONS

Figure 1:
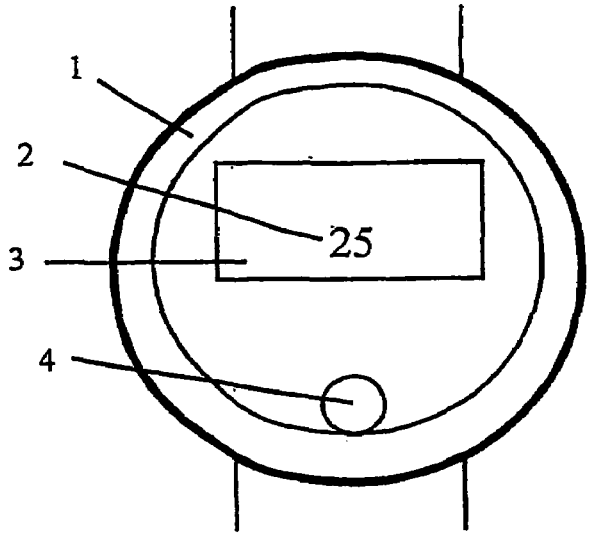

This application is a 371 of PCT/CH03/00099, filed Feb. 8, 2003, which claims priority to PCT/CH02/00435, filed Aug. 8, 2002.

Device for rescue and safety for swimming pools and leisure parks intended to prevent drowning, to remove a person from the water who is in difficulties due to drowning or having fallen in the water with or without human intervention thanks to a water detector, a cardiac-arrest detector and, where it exists, mainly thanks to the help of an inflatable grid described in document WO 01/06076 A1, and/or the engagement of any other rescue and self-protection device capable of alerting rescuers.

This is a new concept, a device consisting of elements to be used depending on the type of environment and making it possible to establish degrees of selection of implementation of means of ensuring safety.

The background for the technique mentions document WO 9718542, which offers a supervision system for public swimming pools.

This document displays numerous disadvantages. The device suggests the supervision of the bottom of public pools, analysing movements when, after a period of 15 seconds of quasi-immobility only an alarm is activated. This device is intended solely for public swimming pools. It only acts as an aid to supervision. It is not autonomous because human intervention remains necessary for recovering a person in difficulties. A lifeguard needs to supervise the swimming pool and a lifesaver must dive to the bottom of the pool in order to find the person, bring her/him to the surface and get her/him out of the water—a delicate operation that takes a considerable amount of time.

If the pool is full of swimmers, it is not easy to dive into the swirling waters among people who are larking about, to find someone on the bottom at a particular spot.

Document U.S. Pat. No. 4,063,410 proposes wristband with a transmitter, but which has the following disadvantages: the cardiac pulse detector is a device on the outside the wristband, it is not an integral part of an automatic rescue device worn by the person. It is not a receiver and cannot receive a broadcast field signal indicating presence. The cardiac pulse detector operates as a device fitted to the wristband, but this option is not incorporated into the wristband. Probes are not included in the wristband, making the wristband unusable in a pool because probes with external wires and a connector are not suitable for use in the water.

Document WO 01/06076 A1 presents a device in the form of an inflatable grid which makes it possible to bring back to the surface a person swimming in the pool and any person in difficulties and all this within a record time, although someone needs to intervene in order to trigger the device, and control of the inflation/deflation process is not covered.

The present invention suggests removing these main disadvantages by reducing the time taken for intervention, either by means of a cardiac-arrest detector, a panic button, location of the person in difficulties and intervention of the lifeguard who will go and find the person, or the cardiac-arrest detector will be attached to an automatic rescue device such as an inflatable grid, for example, as described below.

The inflatable grid consists of a complete device adapted to private swimming pools and public pools that is capable of operating autonomously without human intervention to prevent falls, to bring the person back to the surface and remove people from the water, where the grid can be inflated and deflated in cases of emergency and non-emergency, pinpoint accidents that may occur beside a swimming pool or in a leisure park or ski resort.

Safety in public pools, safety begins with the fact that as each bather arrives she/he puts on her/his wrist a wristband containing a cardiac-arrest detector and a panic button. The wristband is equipped with a means of display including a symbol indicating that it is in working order when the heartbeat is detected.

The device continues to ensure safety by preventing access to the pool to anyone not wearing the wristband, and if removed, the wristband will emit an alarm signal inviting the bather to don or re-don her/his wristband.

Where public pools are equipped with the device described in document WO 01/06076 A1 and thus equipped with an inflatable grid, a location device attached to the grid and in the environment, a panic button and a cardiac-arrest detector will make it possible, through the lifeguard, to activate the uplifting of the grid which will set off an alarm.

As soon as a distress signal emitted from the cardiac-arrest detector or the panic button is detected, the alarm is transmitted to the lifeguard who will decide to activate the grid. At that moment, the device will transmit data collected by the wristband to a central receiving station where it will be displayed and/or printed, while the data will be transmitted to a first aid station, a cancellation code being provided to deal with false alarms. Alternatively, the lifeguard may decide to validate the alarm and warn the first aid station.

If the pool does not have an inflatable grid, the location device would be placed on the bottom, walls and/or beside the pool or in the surrounding area. A lifeguard or other person in the vicinity may use the panic button and trigger an alarm, the position of the problem will be displayed on monitors that will indicate the time and date of receipt of the data, the lifeguard will dive in to find the person or will rush the first aid people to the scene of the accident in leisure parks or ski resorts.

The surveillance monitor or monitors may be situated inside a building, be portable and worn on the belt of supervisors and, if desired, may enable supervisors to communicate with each other.

For Swimming Pools

Safety in private pools begins with the wearing of the wristband by young people, the elderly and pets. It will be programmed to act as a water detector, in the case of an accidental fall into the pool and if the pool is equipped with the inflatable grid, this will be activated and will rise to the surface with the alarm. When the children are bathing, the parents will deactivate the water detector and the cardiac-arrest detector comes into use. In the case of drowning by par immersion syncope, the grid will automatically rise to the surface. Where a person is feeling unwell, the child or other person will press her/his own wristband and the grid will rise to the surface. If a person is alone in the pool and begins to suffocate, to choke, she/he will grip her/his wristband and the grid will rise to the surface.

Where there is no protective grid, the water detector, if activated, or the cardiac-arrest detector, will trigger an alarm indicating that someone has fallen into the pool.

To summarise, in a private pool the device offers three means of safety: by pressing the panic button, by detecting cardiac arrest, and by accidentally falling in (water detector). The water detector function can be activated or deactivated, as required.

At the edge of the pool, for example, there would be a command post with an alarm that would transmit through wires or wirelessly, the data to a first aid station. A cancellation code is included for false alarms and the command post would be capable of being connected to a series of telephone numbers in order to warn the various people closest to the scene who could help.

Panic Button

The panic button is placed in a cavity on the wristband and is covered with a membrane to render it watertight.

Differentiation Between the Wristband being Accidentally hit and an Alarm

When the panic button is pressed to sound the alarm, everyone's reflex is to make sure that the alarm has been raised, so the person will apply longer pressure than if the button is pressed by accident, or the button may be pressed repeatedly or the wrist gripped.

It is thus possible to distinguish initially by the length of the alarm and to recognise alarms that are genuine (If there is a serious practical joker, she or he can be fined).

Contact Button

The surface of the wristband in contact with the wrist is fitted with a push-button which is pushed in when the wristband is closed, activating the pulse detector and when it is operational a lamp lights up, either flashing or constant, and it may either be a LED or a digital display.

Pulse and Cardiac-Arrest Detector

Basic principle: light is emitted, in whatever manner, and the variations thereof are measured. A light sensor is used to measure light passing through human tissue.

Solution a: The light source, an emitter diode, is doubled, the double being positioned opposite to the first so as to ensure that the light passes through human tissue and its reflection is captured by the light sensor, the receptor photodiode. There is a diode beneath the container that is in contact with the wrist and one inside the wristband, under the wrist with the light sensor.

Solution b: It is possible to have two separate receivers, one to sense the reflected signal and one to capture the signal passing through the wrist.

Solution c: Depending on quality of the cardiac pulse detector, this device is installed on either side of the wrist since the movements will interfere with the cardiac pulses and will intermittently interrupt the reading.

Solution d: is to have a diode on the upper side of the wrist, with a reference diode underneath the wrist, which would be placed between two light sensors that would collect the beams from each of the diodes.

Programme on a Loop to Identify Cardiac Arrest

After an initialisation sequence, contact with the wrist and detection of the first pulses, as soon as correct pulse detection is established, the wristband will begin to record pulse measurements in a loop.

Simultaneously, a fault meter will be created and will program the maximum amount of time that the absence of a pulse should be tolerated.

When the panic button is pressed by the bather, the panic button can be triggered in two ways:

continuous pressure of more than . . . X seconds intermittent pressure of more than . . . X seconds this is to prevent accidentally pressing the du panic button.

If the panic button is pressed in either of the ways described above, an alarm code, 2 for example, is transmitted via FM waves to the lifeguard station.

In normal working, the pulse sensor is read by reading the status of the sensor as well as the number of pulses.

If there are no pulses or the sensor does not detect a pulse, the fault meter is brought into play. This meter reading is compared to one that represents a certain number of times per second. If the meter exceeds the maximum amount of time (which means that the loop has been run through several times consecutively and the result has been an absence of pulse each time, i.e. a cardiac arrest) the alarm code changes to 1, then this code is transmitted by FM frequency to the control post.

If the alarm meter does not reach the time limit, nothing happens and the test loop starts again by detecting the panic button.

If the pulse sensor sends correct pulse data before the fault counter reaches the time limit, the meter will be reset to start again. This makes it possible to be pre-armed against errors in reading the pulses during movements or any other sources of interference and prevents the triggering of an alarm except when X consecutive seconds has not produced any further number of pulses.

Access and Exit, Anti-Theft, Failure to Wear the Wristband

Solution a): Access and exit from the activity areas will be via an automatic gate or entry passage fitted with an infrared human presence detectors and a transponder detector which will immediately detect a person entering who is not wearing the wristband by detecting the absence of the transponder. This will trigger an alarm in the form of a revolving flashing light. In addition to the alarm, the automatic gate at the end of the lobby will close or remain closed, thus preventing access to the activities if the wristband is not being worn, and the same applies to the exit procedure.

Solution b): the infrared detector can be replaced by an optical barrier.

Solution c): A presence-detecting pressure mat or strip could activate an alarm and/or a revolving light, by indicating that someone has stepped out of the restricted area. Where there is an entry lobby, a location detector could be installed that would detect that the wristband was not being worn and would trigger an alarm, causing the gate to the activities to lock.

If a bather removed her/his wristband, the wristband would emit an alarm lasting X seconds and if the bather refused to re-don the wristband, she/he would do so entirely on their own responsibility.

Lockers and Transponders

Each wristband has a transponder with its own frequency that corresponds to the locker number and enables the locker to be opened and closed.

The lockers are managed by a microcontroller, either in rows or covering all of the lockers.

Note: if there are no lockers, the wristbands are either issued at the cash desk or by an automatic vending machine and/or could be rented by membership subscription. The passage through the lobby with the wristband could ensure that the customer is wearing the wristband, and a payment function could be incorporated in the wristband for paid activities, amusement parks, ski resorts, etc.

Water Detector

Mainly in the case of private swimming pools, the wristband could also be fitted with a cardiac-arrest detector and a water detector. This function could be activated and deactivated by various means, by a code, by pressure, by means of a little spike attached to a button inside the box, a key, or by turning a ring or by using a selector, as chosen by the manufacturer, this description being non-restrictive.

If a person falls into the water, her/his wristband would send a signal from the transmitter. The receiver receives the signal and activates the electronically-controlled valve using a relay that would cause the grid to be uplifted to the surface and/or set off an alarm.

The water detector consists of a duct, in whatever form, with at least two openings and with electrodes inside the duct. To discharge the water, the wristband merely needs to be shaken or blown into. As a variation, simple contacts could be positioned sufficiently far apart, on either side of the wristband and not in contact with the skin, which could be rendered watertight by means of valves or sliding plates, the method being non-restrictive.

The invention will be better understood when a description of a method of implementation in relation to swimming pools, given here as a non-restrictive example, on the basis of the figures referred to therein.

FIG. 1: represents a wristband (1) the locker number (2) shown in the liquid crystal display (3) and a panic button (4).

Figure 2:
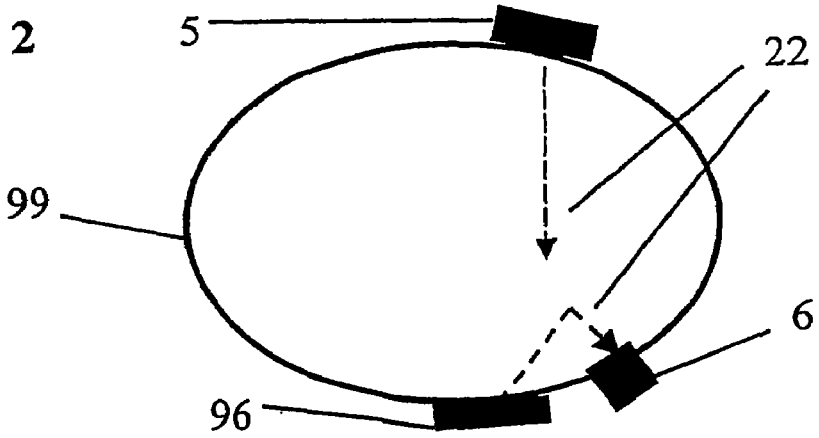

FIG. 2: represents a vertical section (99) showing the electroluminescent diodes (5) that emit the beam (22) through human tissue and another diode (96) whose beam (22) is reflected on the light sensor (6).

Figure 3:
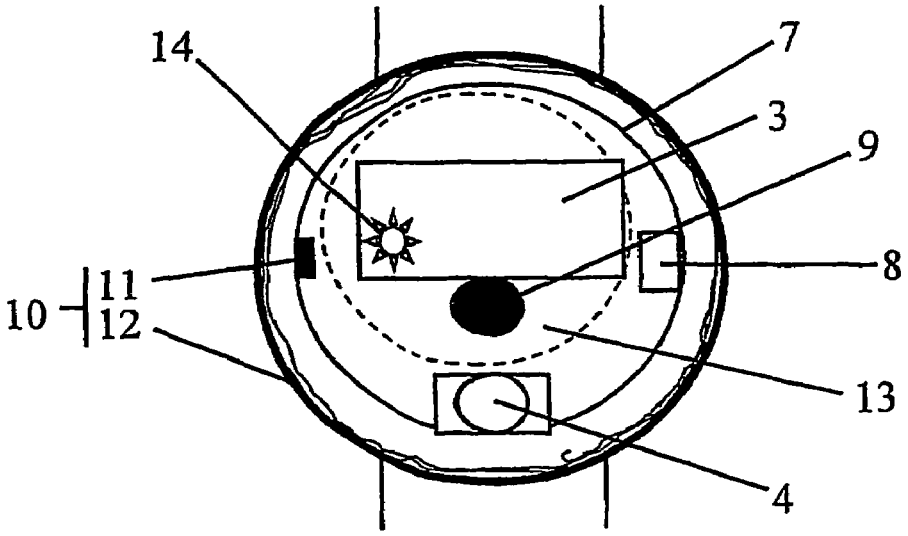

FIG. 3: represents the interior of the box on the wristband (1) showing the printed circuit (7) that also contains the transmitter (8) that sends the signal which activates the rescue system as well as the microcontroller (9) and the transponder (10), its receiving/transmitting circuit (11) and the coils (12). The interior of the box also includes a battery (13), and the liquid crystal display screen (3), the panic button (4) and the symbol (14) indicating that the wristband is in working order can also be seen.

Figure 4:
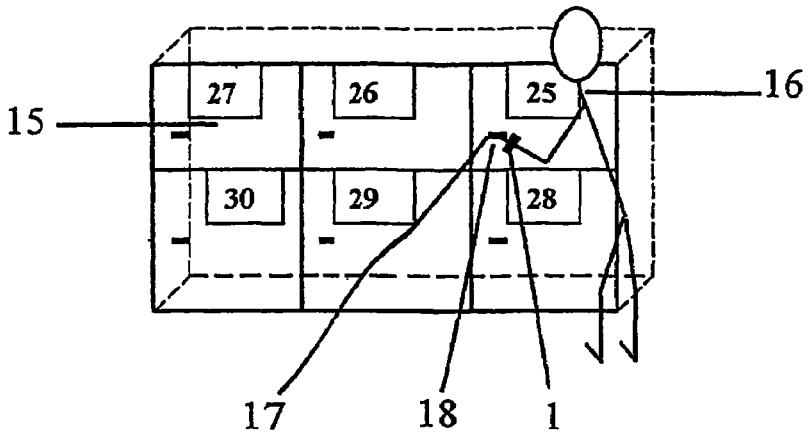

FIG. 4: represents the lockers (15) in the closed position and the bather (16) presenting the wristband (1) to the "lock" (17) on locker no. 25 in order to open the door.

The transponder situated on the wristband is positioned in front of the lock (17) activating it without physical contact, thanks to the transponder detector (18) attached to the locker.

Figure 5:
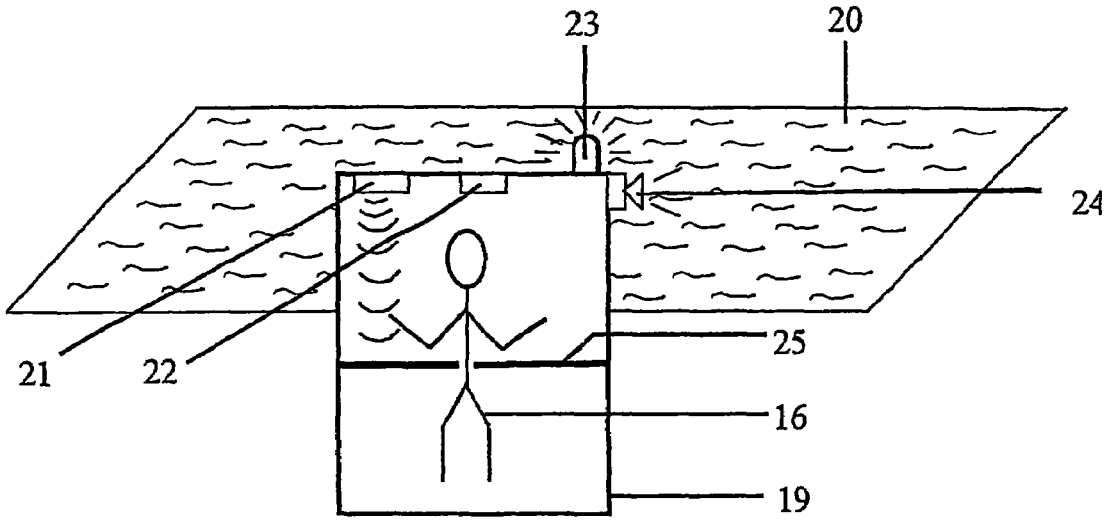

FIG. 5: represents the bather (16) passing through a door (19) that leads to a swimming pool (20) and an infrared human presence detector (21) detecting the presence of the bather, thanks to a transponder detector (18) determining that the bather (16) is not wearing her/his wristband and consequently activating a rotating light signal (23) and an alarm signal (24), the automatic gate (25) remaining shut.

Figure 6:
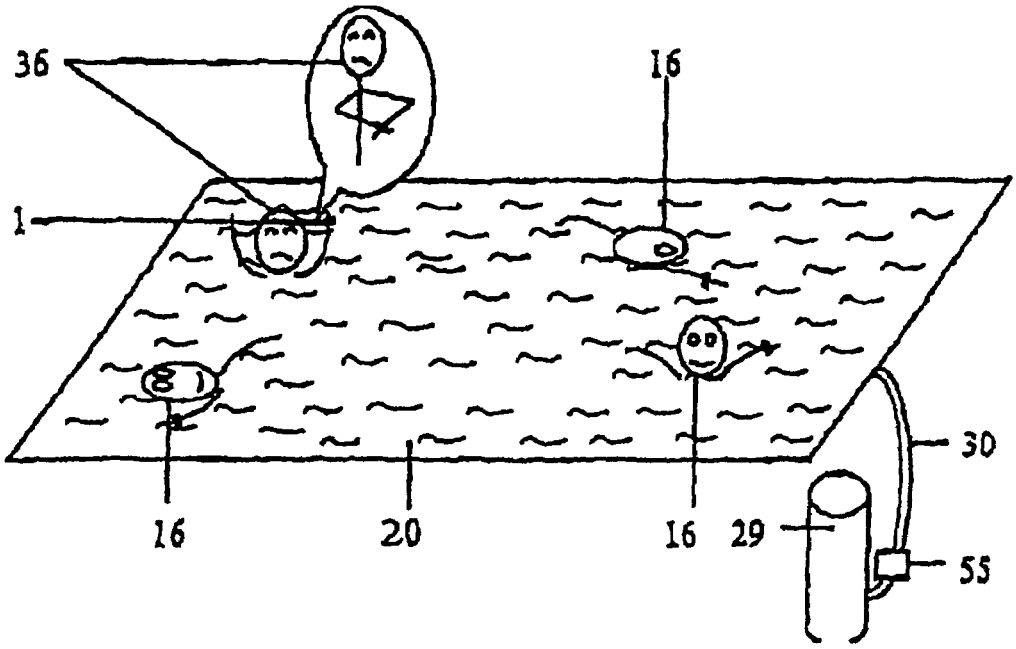

FIG. 6: represents the swimming pool (20) with an inflation system on one side, a source of compressed air/gas (29), the hose (30) that links the source of air/gas (29) to the grid on the bottom of the pool, the electromagnetic gate-valve (55) and a swimmer in difficulties (36) wearing a wristband (1) and pressing it, thus activating the electromagnetic gate-valve (55) and the rescue plan. Other swimmers (16) can be seen moving in the pool.

Figure 7:
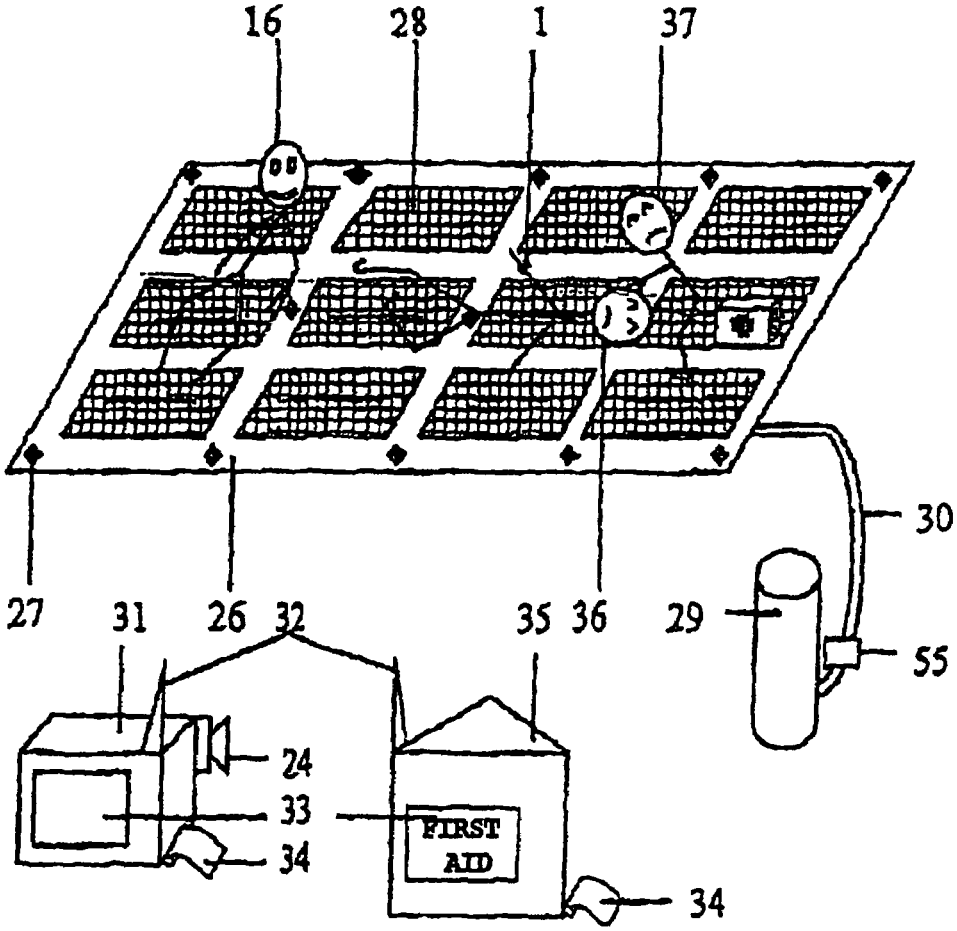

FIG. 7: represents the inflated grid (26) in its raised position with the location detection device (27), with unlockable and relockable sections (28), swimmers (16) scooped up by the grid, the swimmer in difficulties (36) and a lifeguard (37) who is able to administer first aid straight on the grid. The distress signal originating from the wristband (1) has been sensed by the antenna (32), inflation is triggered via the microcontroller (9) not represented here, which activates the electromagnetic gate-valve (55), causing the grid (26) to uplift and activating the siren alarm (24). The data has been transmitted simultaneously to the command post (31) beside the pool, as well as the to first-aid centre (35) where it is displayed on the screens (33) and printed on the printers (34). The air/gas (29) tank is also shown.

Figure 8:
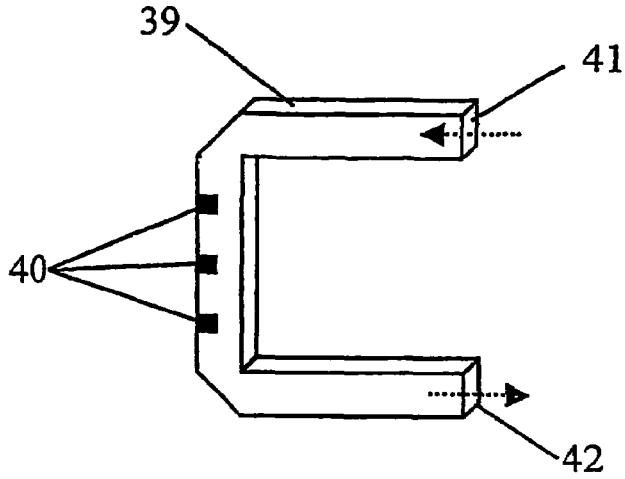

FIG. 8: represents a design for the water detector (39), using three electrodes (40) and a duct (41) with water circulating (42) through the duct.

Figure 9:
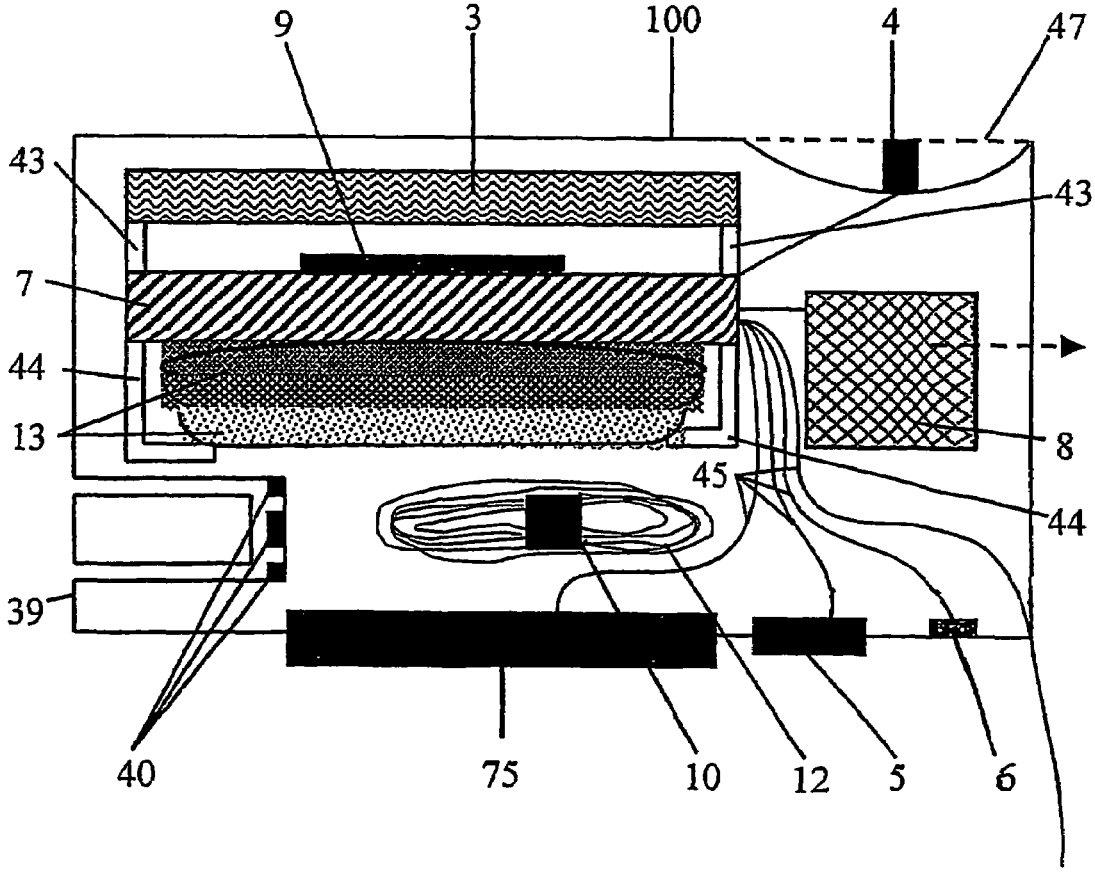

FIG. 9: represents an example of a vertical section through the box on the wristband (100) with the panic button (4), the liquid crystal display screen (3) and separators (43), the microcontroller (9), the printed circuit (7), the transmitter (8) a battery (13) and an emergency battery (13), the battery contacts (44), the water detector (39) and its electrodes (40), the transponder (10), the coils (12), the contact button (75) the wires (45) for the light sensor (6) and for an electrode (5) as well as the electrode wire which runs inside the wristband, the wire (45) to the contact button (75) and a light sensor (6) linked to the printed circuit (7).

FIGS. 10*a* and *b*: represent an example of a mooring that enables the grid to be uplifted thanks to strap-guides (53) fixed beneath the flanges (52), the straps (51) being fixed to a support (54) that is above the water level, and an example of support bars (97), that may be round or rectangular and that are slid into the strap-guides (53) and rested on the side of the pool (20).

Figure 11:
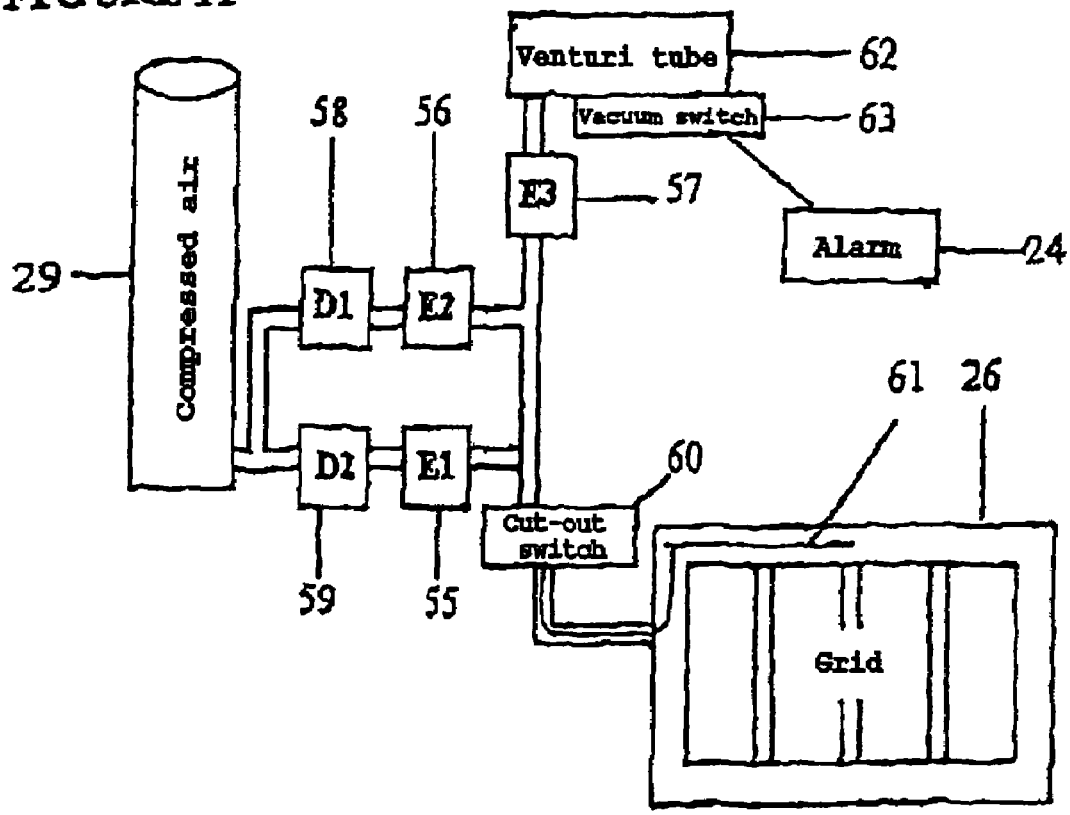

FIG. 11: represents an example of the basic layout showing a compressed air/gas tank (29) three electromagnetic gate-valves E1 for an emergency (55), E2 for a non-emergency (56) and E3 for evacuation (57) two emergency escape valves D1 (58) and D2 for non-emergencies and evacuation (59), a cut-out switch (60) with a probe (61), a venturi tube (62), a vacuum switch (63) and the battery (26)

Figure 12:
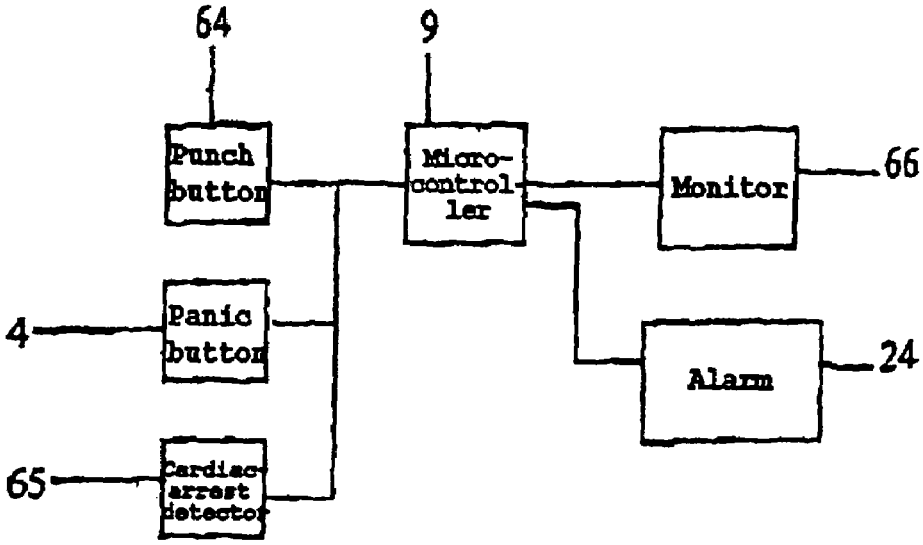

FIG. 12: represents an example of the basic layout, with the punch button (64), panic button (4) cardiac-arrest detector (65) microcontroller (9), monitor (66) and alarm (24)

Figure 13:
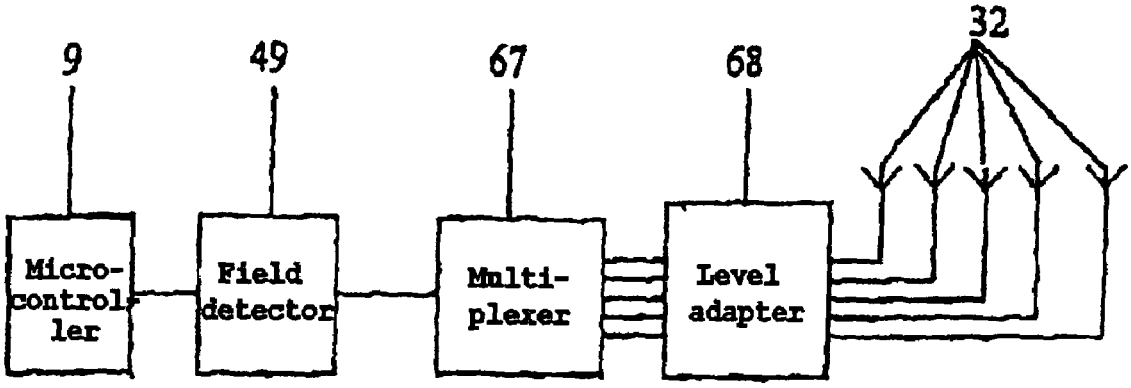

FIG. 13: represents a field detector (49), a multiplexer (67) with a level adaptator (68) and antennae (32) and a microcontroller (9).

Figure 14A:
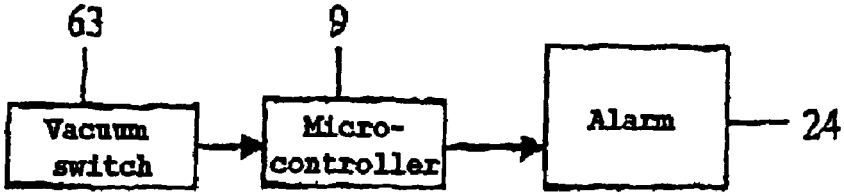
Figure 14B:
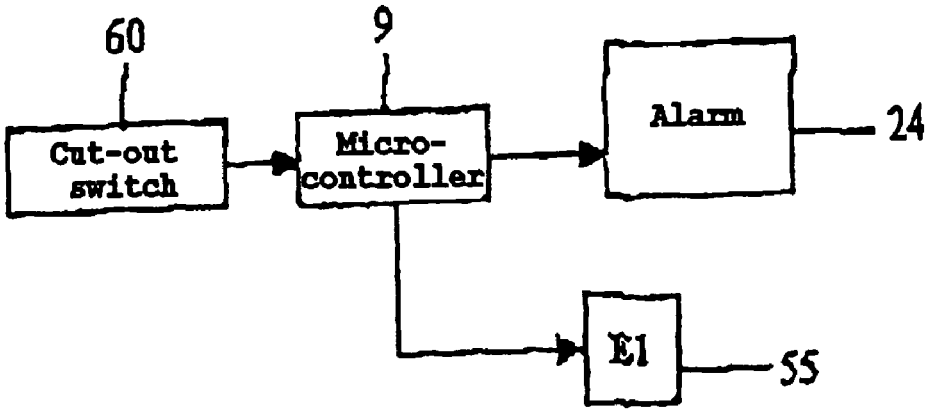

FIGS. 14*a, b* and *c*: represents examples of pneumatic layouts.

14*a*): vacuum switch controlling the vacuum (63), microcontroller (9) and alarm (24).

14*b*): cut-out switch for controlling the inflation (60) microcontroller (9) electronically controlled gate-valve E1 (55) and alarm (24).

14*c*): the microcontroller (9) to which the cut-out switch (60), on the left in the drawing, is connected, the punch button (64), the panic button (4), the cardiac-arrest detector (65), the uplift and non-emergency button (69), the vacuum switch (63), the descent button (70), the lifeguard button (71) and a command keyboard (72). The right hand-side of the diagrams shows electronically controlled gate-valve E1, the emergency electronically controlled gate-valve (55), electronically controlled gate-valve E2 for non-emergencies (56), electronically controlled gate-valve E3 for evacuating the air (57), the venturi tube (62), the lifeguard's alarm (24), a monitpr (66), a display to the command post (73) and a computer (74).

Figure 15:
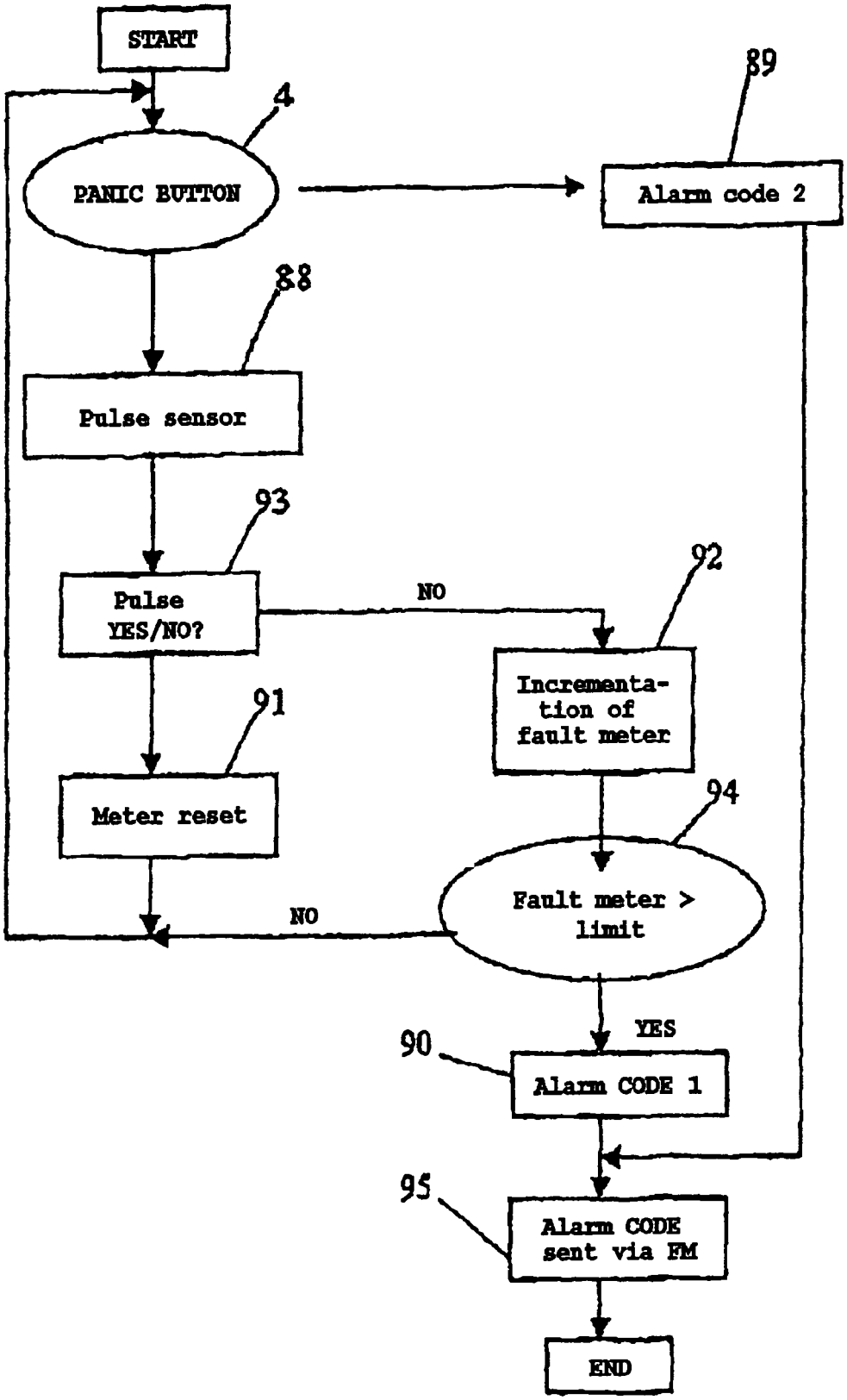

FIG. 15: represents the flowchart of the programme controlling management of alerts by reading the pulse sensor.

After the start, depart, note the panic button (4),
reading the pulse sensor (88)
determining whether there is a pulse (YES or NO) (93)
resetting the fault meter to zero (91)
alarm code 2 (89)
incrementation of the fault meter (92)
meter total>showing that the acceptable limit (94) has been exceeded resulting in
alarm code 1 (90)
sending the alarm code via FM (95)
end of cycle Here is an example of a non-restrictive implementation, based on the figures described above. The example used here is a public swimming pool fitted with an inflatable grid.

There are many drownings in public pools due mainly to:

Drowning through immersion syncope, causing cardiac arrest which in turn causes the person to sink immediately, through losing consciousness and ceasing to move the person drowns through feeling discomfort, then choking, she/he suffocates and swallows quantities of water The bather (16) arriving at the swimming pool (20) goes to the locker area (15) and finds, attached to the locker or cupboard, a wristband (1) bearing the number of locker 25 which is displayed on a liquid crystal display screen (3). The bather (16) shows the box on the wristband (1) to the "lock" (17) on the locker, the locker (15) opens, she/he puts their clothes inside, FIG. 4, attaches the wristband with box to her/his wrist, and a symbol (14) starts flashing at the rate of the heartbeat or lights up indicating the wristband FIG. 3 is working order. In this example, surveillance stops when the wristband-wearer returns to the locker area.

The wristband (1) is fitted with a module containing:

electroluminescent diodes (5) (96), a light detector (6) FIG. 2, a printed circuit (7), the transmitter (8), the microcontroller (9), the transponder (10) the coils (12) and a battery (13) FIG. 3.

They are linked wirelessly by radio waves such as by FM or AM frequencies to a central receiver (31), a console equipped with a screen and printer at the poolside (20) or by SMS text messaging and this is linked in turn to a first-aid station (35) such as the police, ambulance or fire service FIG. 7.

The inflatable grid (26) is inflated by a compressed air/gas supply (29), with its own system of inflation and deflation as per FIGS. 11 and 14*a, b* and *c*. The deflated grid is placed on the bottom of the swimming pool.

In a case of drowning by immersion syncope, for example, where the person passes out due to cardiac arrest or where the person has a heart attack, the heart rate accelerates or decelerates sharply, the heart stops beating, and the microcontroller recognises a signal corresponding to this heart problem transmitted by the diodes (5 and 96) FIG. 2, sends a signal through the external transmitter (8) FIG. 3 on the wristband (1) which then reaches the receiver at the command post (31) at the poolside, where the date and time of the cardiac arrest is displayed, the microcontroller (9) located in the command post, (not shown here), activates the electronic gate-valve that causes the grid to uplift and also transmits the data to the first-aid post.

(35) FIG. 7. The alarm sounds, and the lifeguards can administer first aid.

After evacuation, the grid is deflated by activating the descent button, and it is raised to the surface by activating the uplift button so it can be used as a cover or games surface. The descent, uplift and non-emergency buttons can be designed in the form of remote controls.

Controlling Inflation and Deflation,

There are two situations in which the grid is inflated.

a) In case of an emergency b) In the case of a non-emergency, to place the grid in the raised position, to serve as protection, as a cover, as a games surface or to clean the bottom of the pool.

In the case of an emergency, there are two options: the punch button, in which the system is triggered automatically thanks to the functions of the wristband.

Inflation in the case of a non-emergency and deflation are performed by using the descent or uplift button which can be provided in the form of remote controls to make the grid re-descend, in which case the grid must contain ballast.

Figure 14C:
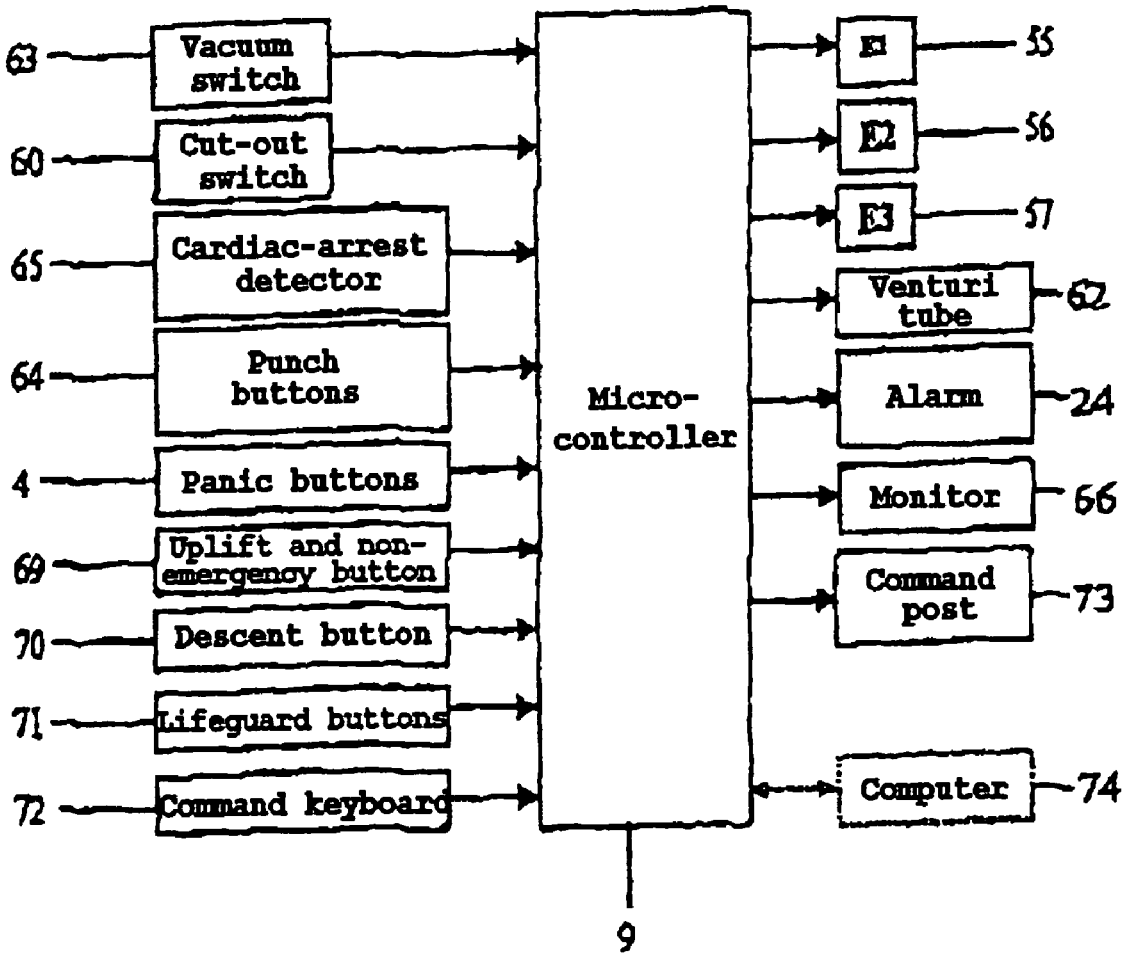

The pneumatic flowchart in FIG. 14*c* which is for indication only and is non-restrictive operates as follows:

In a Non-emergency

If the uplift is activated (69): the Venturi tube (62) is cut off, the electronic gate-valve E3 (57) is shut and electronic gate-valve E2 (56) is opened.

If the descent button is activated: electronic gate-valve E2 (56) is closed, electronic gate-valve E3 (57) is opened, and the venturi tube (62) and vacuum switch (63) are engaged.

In an Emergency

If the lifeguard button or—in the case of private pools—the panic button or cardiac arrest detector are activated: the venturi tube (62) is cut, the E3 (57) is closed and the E1 (55) is opened.

These operations are performed via the microcontroller.

This sequence is non-restrictive, and it is possible to use electronic gate-valves with 2 or 3 channels, and several sources of air/gas can be used with several electronic gate-valves being used simultaneously.

Basic Diagram based on FIG. 12

If the punch button (64) is activated, this is displayed on the monitor (66) and an alarm sounds (24)

If the panic button is activated (4): the same will happen as above.

If the cardiac-arrest detector (65) is activated, the same happens as above with cardiac arrest being specified and the monitor will indicate the time at which the message was received.

The lifeguard will be able to see at a glance if this is a real problem by looking at the screen and in the pool, and she/he will trigger the grid, and the first-aid authorities will be warned. In the case of a private pool, the emergency services will be alerted.

Safety Assured for the Lowered Position FIGS. 11 and 11*a*

An electric or pneumatic venturi tube (62) activated by the microcontroller(9), is used to deflate the grid, this venturi tube being accompanied by a vacuum switch (63) which creates the degree of vacuum necessary for maintaining the grid on the bottom. It is connected to the alarm (24) FIG. 11, so that if it develops a leak, due to vandalism for example, the leak is signalled immediately. FIG. 11*a*.

Safety Assured when the Grid is Inflated FIGS. 11 and 11*a*

This is ensured via the microcontroller(9), through a two-stage cut-out switch (60) connected to an alarm (24); if the lower threshold is reached, there is an air leak, and the alarm (24) FIG. 11 sounds, requiring bathers to leave the grid and inflation is activated automatically via the electronic gate-valve E1 (55) FIG. 14*a*.

Uplifting the Grid

Figure 10:
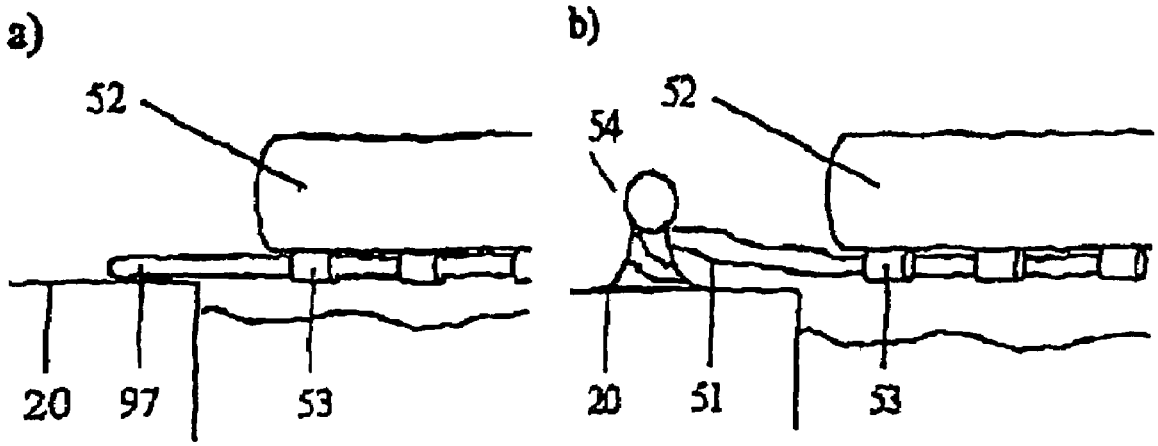

This is performed either by the strap guides (53) fixed to the flanges (52), with straps (51) which are attached to the supports (54) that are above water level, or by supporting bars (97), slid through the strap guides which then become bar-holders. FIG. 10. The bars are extendable and once they have been pulled out will rest on the poolside above the water level. This makes it possible for the robotic arm circulating on the bottom of the pool to come to the surface in the case of robots with an arm.

Locating the Person

Location detectors (27) are placed, as required, in the environment, at the pool side or at the four corners of the pool (20) and/or on the grid (26), making it possible to determine by deduction and triangulation the position of the person in difficulties (36) FIG. 7. The greater the number of receptors on the grid or in an area, the more precise the pinpointing of the location of the person, FIG. 7 can be. In the case of private pools, which are generally small, a location finder should not be necessary, unless a large property is owned and one wants to extend protection to other accidents over the whole area.

Location is determined through the positioning of receiver antennae (50) that pass through a level adapter (68) a multiplexer (67), field detectors (49) and the microcontroller (9). In FIG. 13, the number of field detectors has been reduced by multiplexing the antennae. An antenna detects the FM signal emitted by the wristband at the time of the alarm. In some cases, it is possible to have a single field detector and a single multiplexer for the antennae.

The frequencies of FM and AM antennae are subject to change, so they are not mentioned here.

Zones

The location detection device can be adapted to zones or sub-zones in the case of amusement parks, leisure parks, ski resorts and holiday clubs. The wristband will include the cardiac-arrest detector, the panic button and, if there are aquatic zones, a water detector. The wristband will be associated with a human presence detector and any self-protection device such as a barrier that is raised if anyone moves into a danger zone for instance.

The antennae can be linked to one or more solar batteries, as well as to any device making it possible to detect the passage of the wristband into a zone.

The invention claimed is:

1. Device for rescue and safety for swimming pools or recreational water parks, comprising:

a wristband (1) including:

a cardiac-arrest detector (65), a printed circuit (7), a transmitter (8), a microcontroller (9), a transponder (10), at least one battery (13), a personal identification code (2), a means of display (3), a panic button (4), and a contact button (75) including:

a push button in contact with a wrist of the user and which, when pushed when the wristband is in a closed configuration about the wrist, activates a pulse detector (88), and when the pulse detector is activated, a light (14) is activated;

means of managing the cardiac arrest detector and the panic button;

means to trigger an automatic rescue device; and a location device (27) with at least one central receiver for communicating with at least one control center (31) and transmitting a warning signal to an emergency center (35).

2. Device according to claim 1, wherein the wristband contains a water detector (39) that includes means for activating/deactivating the automatic rescue device.

3. Device according to claim 1, wherein the automatic rescue device is an inflatable grid (26) including means for raising the grid, means for checking a degree of vacuum in the grid to maintain the grid in a deflated state, and means for the inflation/deflation of the grid.

4. Device according to claim 1, wherein the means for managing the panic button (4) and the cardiac-arrest detector (65), includes:

a pulse detector (88) with two light sources (5, 96) in the form of electroluminescent diodes, one of the light sources (5) being located on the wrist (99) of the user and passing through human tissue of the user, and the other light source (96) being located beneath the wrist, these light sources (5, 96) being included in the wristband, with light emitted by one of the light sources (96) being incident on a light sensor (6), means for generating an alarm code (89) in response to pressing of the panic button (4), the cardiac-arrest detector (65) for performing a YES/NO determination of whether a pulse is present (93) and for reading pulses in a software processing loop (88), and a fault meter, operating with the software processing loop (88), with a re-setting procedure (91), and with a maximum fault tolerance threshold, for performing a count of the pulses, capable of transmitting alarm codes (95) on a FM radio signal, either when the fault meter pulse count has exceeded a predetermined limit or when the panic button (4) is activated.

5. Device according to claim 4, wherein the pulse detector (88) consists of a 2×2 array of diodes (5,96), located on either side of a half-wrist band above/below the wrist, with two light detectors (6) on either side of the wrist.

6. Device according to claim 4, wherein the pulse detector (88) includes a first diode (5), located on one side of the wrist and a reference diode (96) on the opposite side of the wrist, which is surrounded by two light sensors (6) for detecting the light from each of the diodes.

7. Device according to claim 1, wherein the wristband (1) includes the personal identification code (2) recorded in the transponder (10), which, in conjunction with a transponder detector (18), is capable of opening and closing doors and lockers, and triggering an alarm (24) with the opening and closing of lockers being managed overall or in rows via the microcontroller (9).

8. Device according to claim 2, wherein the water detector (39) includes at least one of:

a duct (41) with at least two apertures through which water can enter (42), the duct (41) containing electrodes (40) connected to a water detection circuit for actuating the rescue device or an alarm; and two contacts spaced apart from each other and not in contact with the skin of the user with protective coverings rendering them watertight during bathing.

9. Device according to claim 1, wherein the wristband (1) includes:

a housing, the panic button (4), and the contact button (75) which includes the push button in contact with the wrist, each of which is located inside the housing and covered by a watertight membrane (47).

10. Device according to claim 1, wherein the location detector device (27) includes field detectors (49) with antennae (32) passing through a multiplexer (67), a level adapter (68) and the microcontroller (9).

11. Device according to claim 3, wherein the inflation of the grid (26) is managed by an inflation system, including a compressed air/gas (29) pipe, an emergency electro-valve (55), a non-emergency electro-valve (56), an electro-valve for discharging (57) and a pressure relief valve (58) for emergencies should the necessary inflation pressure not be the same as that required for powering the discharge, a pressure relief valve (59) for non-emergencies, a cut-out switch (60), a venturi tube (62) and a vacuum switch (63) for controlling the vacuum, wherein the entire inflation system is managed by the microcontroller (9) to which is functionally connected a component device selected from the group consisting of: the cardiac-arrest detector (65), the panic button (4), the contact button (75) with the push button in contact with the user's wrist, a non-emergency reset button (69), a vacuum switch (63), a descent button (70), a lifeguard button (71), an alarm (24), a monitor (66), a control keyboard (72), a display panel for the control center (73), a computer (74), and combinations thereof.

12. Device according to claim 3, wherein the grid (26) includes flanges and is raised either by straps (51) and strap guides (53) fixed under the flanges or by extendable bars (97) which are housed in the strap guides (53), the supporting bars, once extended, resting on the edge of a swimming pool, the grid (26) raised in order to enable a robotic arm of a robot to slide over the surface of the water.

13. Device according to claim 1, wherein the location detector device (27) is connected to at least one solar battery or batteries.

14. A wristband for attachment to the wrist of a person using a swimming pool or other prescribed bodies of water, the wristband comprising:

a cardiac-arrest detector (65),
a printed circuit (7),
a transmitter (8),
a transponder (10),
a personal identification code (2),
a means of display (3),
a panic button (4), and
a contact button (75) electronically coupled to said microcontroller and including:
a microcontroller (9) mounted on the printed circuit (7) and for controlling electronic communications with said cardiac-arrest detector (65), said transmitter (8), said transponder (10), said means of display (3) and said panic button (4);
a push button in contact with a wrist of the user and which, when pushed when the wristband is in a closed configuration about the wrist, activates a pulse detector (88), and when the pulse detector is activated, a light (14) is activated.

15. A warning and rescue system for personnel in a contained aquatic environment, the system comprising:

a. an automatic rescue apparatus submerged at a predetermined depth in the contained aquatic environment;
b. an actuator means associated with the automatic rescue apparatus that activates the automatic rescue apparatus in response to a distress signal;
c. a personal detection and signaling apparatus for attachment to personnel in the aquatic environment that includes:
(i) signal generating means for periodically transmitting a unique personal identification code,
(ii) a cardiac arrest detector having a pulse sensor and sensor mounting means,
(iii) a processor/controller,
(iv) a transponder,
(v) a power source, and
(vi) a panic button operatively connected to a signal transmitter; and
d. a personnel location monitor with at least one central receiver for communicating with at least one safety control center.

16. The warning and rescue system of claim 15, wherein the personal detection and signaling apparatus includes:

(vii) a wristband including:
the cardiac-arrest detector,
a printed circuit,
a transmitter including the signal generating means,
a microcontroller including the processor/controller,
the transponder,
at least one battery included in the power source,
a personal identification code,
a display,
the panic button,
a contact button including:
a push button in contact with a wrist of a user and which, when pushed when the wristband is in a closed configuration about the wrist, activates the pulse sensor, and when the pulse sensor is activated, a light is activated, and
means for managing the cardiac arrest detector and the panic button.

17. Device for rescue and safety for swimming pools or recreational water parks, comprising:

a wristband (1) including:
a cardiac-arrest detector (65),
a printed circuit (7),
a transmitter (8),
a microcontroller (9),
a transponder (10),
a personal identification code (2),
a means of display (3),
a panic button (4), and
a contact button (75) including:
a push button in contact with a wrist of the user and which, when pushed when the wristband is in a closed configuration about the wrist, activates a pulse detector (88), and when the pulse detector is activated, a light (14) is activated;
means to trigger an automatic rescue device, said rescue device being an inflatable grid (26);
means for inflating and deflating said grid; and
a location device (27) with at least one central receiver for communicating with at least one control center (31) and transmitting a warning signal to an emergency center (35).

18. Device according to claim 17, further comprising means for checking a degree of vacuum in the grid to maintain the grid in a deflated state.

19. Device for rescue and safety for swimming pools or recreational water parks, comprising:

a cardiac-arrest detector (65);
a transmitter (8);
a transponder (10);
display (3);
a panic button (4);
a switch;
a microcontroller (9) for controlling electronic communications with said cardiac- arrest detector (65), said transmitter (8), said transponder (10), said display (3), said panic button (4) and said switch;
a contact button (75) electronically connected to said microcontroller and including:
a push button in contact with a wrist of the user and which, when pushed when the wristband is in a closed configuration about the wrist, activates a pulse detector (88), and when the pulse detector is activated, a light (14) is activated.

20. Device according to claim 19, further comprising an automatic rescue device in the form of an inflatable grid (26) including means for raising the grid, means for checking a degree of vacuum in the grid to maintain the grid in a deflated state, and means for the inflation/deflation of the grid; and means to trigger the grid.

21. A wristband for attachment to the wrist of a person using a swimming pool or other prescribed bodies of water, the wristband comprising:

a cardiac-arrest detector (65), a printed circuit (7), a transmitter (8), a transponder (10), a personal identification code (2), a means of display (3), a panic button (4), and a contact button (75) electronically coupled to said microcontroller and including:

a microcontroller (9) mounted on said printed circuit (7) and for controlling electronic communications with said cardiac-arrest detector (65), said transmitter (8), said transponder (10), said means of display (3) and said panic button (4);

a push button in contact with a wrist of the user and which, when pushed when the wristband is in a closed configuration about the wrist, activates a pulse detector (88), and when the pulse detector is activated, a light (14) is activated, means to trigger an automatic rescue device, said rescue device being an inflatable grid (26); and means for inflating and deflating said grid.

22. Device according to claim 21, further comprising means for checking a degree of vacuum in the grid to maintain the grid in a deflated state, and means for the inflation/deflation of the grid.

* * * * *